US009587456B2

(12) United States Patent
Roth

(10) Patent No.: US 9,587,456 B2
(45) Date of Patent: Mar. 7, 2017

(54) PACKER SETTING METHOD USING DISINTEGRATING PLUG

(71) Applicant: Saudi Arabian Oil Company, Dhahran (SA)

(72) Inventor: Brian A. Roth, Dhahran (SA)

(73) Assignee: Saudi Arabian Oil Company, Dhahran (SA)

( * ) Notice: Subject to any disclaimer, the term of this patent is extended or adjusted under 35 U.S.C. 154(b) by 45 days.

(21) Appl. No.: 14/309,599

(22) Filed: Jun. 19, 2014

(65) Prior Publication Data

US 2015/0368997 A1 Dec. 24, 2015

(51) Int. Cl.
*E21B 33/12* (2006.01)
*E21B 33/00* (2006.01)
*E21B 33/128* (2006.01)

(52) U.S. Cl.
CPC ..... *E21B 33/12* (2013.01); *E21B 33/00* (2013.01); *E21B 33/1285* (2013.01)

(58) Field of Classification Search
CPC ..... E21B 23/06; E21B 33/1285; E21B 34/14
See application file for complete search history.

(56) References Cited

U.S. PATENT DOCUMENTS 2,368,399 A * 1/1945 Baker ..... E21B 33/1204 166/122
2,442,642 A * 6/1948 Eckel ..... F16K 15/042 137/512
2,540,455 A * 2/1951 Penick ..... E21B 33/1265 166/119
2,578,900 A * 12/1951 Ragan ..... E21B 33/1265 166/119
2,765,854 A * 10/1956 Lewis ..... E21B 33/14 166/212
2,815,081 A * 12/1957 Church ..... E21B 23/06 166/124
3,087,548 A * 4/1963 Graham ..... E21B 33/138 166/120
4,354,554 A 10/1982 Calhoun
(Continued)

FOREIGN PATENT DOCUMENTS

WO WO 2013/003111 1/2013

OTHER PUBLICATIONS

Baker Hughes, "IN-Tallic Disintegrating Frac Balls", copyright 2014, http://www.bakerhughes.com/news-and-media/resources/brochures/in-tallic-disintegrating-frac-balls-overview, 2 pages.
(Continued)

*Primary Examiner* — Shane Bomar
(74) *Attorney, Agent, or Firm* — Fish & Richardson P.C.

(57) ABSTRACT

Some examples of a packet setting method using disintegrating plug can be implemented as a method for setting a packer in a wellbore. A disintegrating plug is installed in a tubing. The disintegrating plug blocks flow through the tubing in response to pressure. A packer is installed above the disintegrating plug in the tubing. The tubing including the packer and the disintegrating plug is run into a wellbore. The packer is positioned at a wellbore location to create an annular area between the packer and the wellbore wall. Downhole pressure is applied in the tubing to set the packer.

18 Claims, 7 Drawing Sheets

(56) References Cited

U.S. PATENT DOCUMENTS

| | | | | |
|---|---|---|---|---|
| 4,433,725 | A * | 2/1984 | Bowyer | E21B 17/07 166/381 |
| 4,615,389 | A | 10/1986 | Neely | |
| 4,664,188 | A | 5/1987 | Zunkel | |
| 4,953,617 | A * | 9/1990 | Ross | E21B 23/006 166/187 |
| 5,398,763 | A * | 3/1995 | Watson | E21B 23/02 166/162 |
| 7,798,236 | B2 | 9/2010 | McKeachnie et al. | |
| 8,291,969 | B2 | 10/2012 | Swor et al. | |
| 8,327,931 | B2 | 12/2012 | Agrawal et al. | |
| 8,403,037 | B2 | 3/2013 | Agrawal et al. | |
| 8,496,052 | B2 | 7/2013 | Frazier | |
| 9,016,390 | B2 * | 4/2015 | Stewart | E21B 33/126 166/181 |
| 9,115,562 | B2 * | 8/2015 | Guidry | E21B 43/26 |
| 2011/0132621 | A1 | 6/2011 | Agrawal et al. | |
| 2011/0186306 | A1 * | 8/2011 | Marya | E21B 33/12 166/386 |
| 2011/0259603 | A1 | 10/2011 | Kent | |
| 2012/0085548 | A1 * | 4/2012 | Fleckenstein | E21B 34/063 166/373 |
| 2012/0181032 | A1 | 7/2012 | Naedler et al. | |
| 2013/0062063 | A1 * | 3/2013 | Baihly | E21B 23/04 166/297 |
| 2013/0075109 | A1 | 3/2013 | Frisby et al. | |
| 2013/0092400 | A1 * | 4/2013 | Stewart | E21B 33/126 166/387 |
| 2014/0116732 | A1 * | 5/2014 | Acosta | E21B 23/00 166/387 |
| 2016/0201425 | A1 * | 7/2016 | Walton | E21B 33/129 166/376 |

OTHER PUBLICATIONS

Terves Inc., "Frac Balls", Copyright 2013, http://tervesinc.com/frac-balls/, 3 pages.

Halliburton; "Mirage Disappearing Plug and Autofill Sub"; Dec. 31, 2010; 2 pages; retrieved from the internet: http://www.halliburton.com/public/cps/contents/Data_Sheets/web/H/H00093.pdf.

International Search Report and Written Opinion issued in International Application No. PCT/US2015/035057 on Jan. 28, 2016; 15 pages.

* cited by examiner

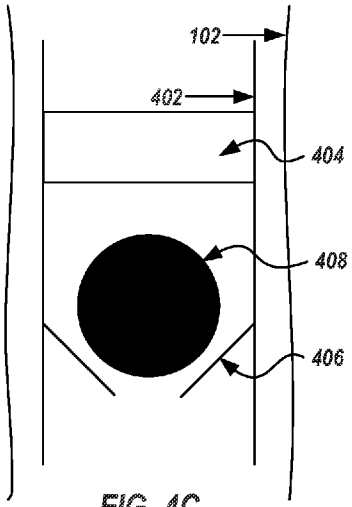
FIG. 4A
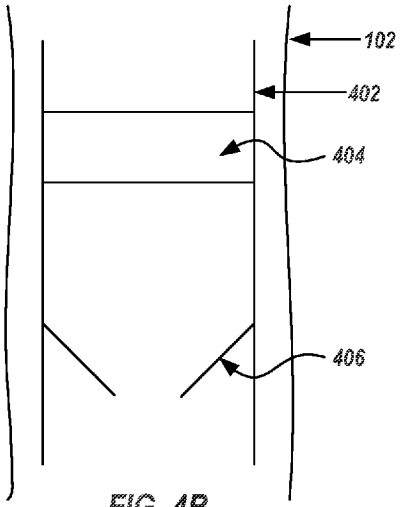
FIG. 4B
FIG. 4C
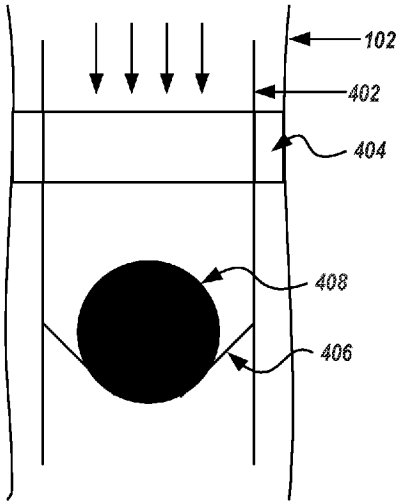
FIG. 4D
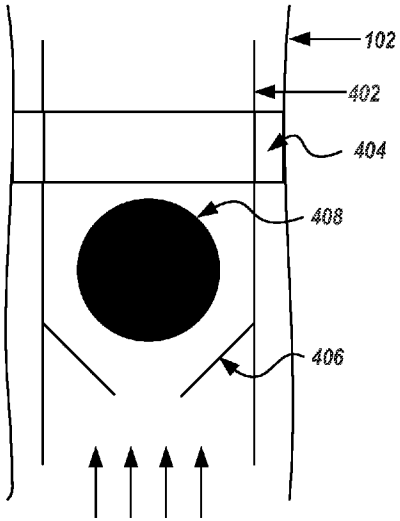
FIG. 4E
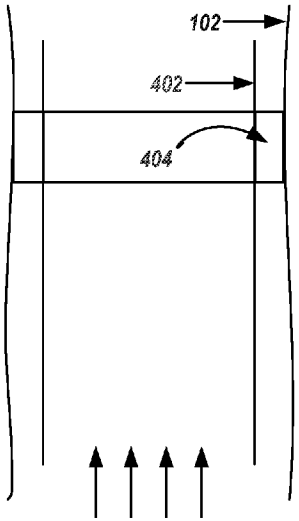
FIG. 4F

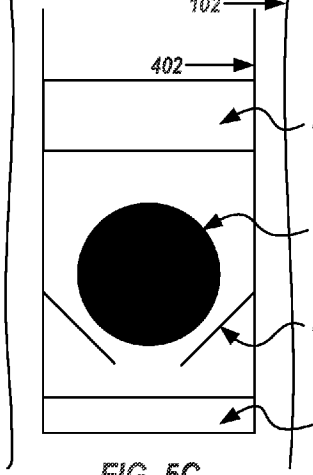
FIG. 5A
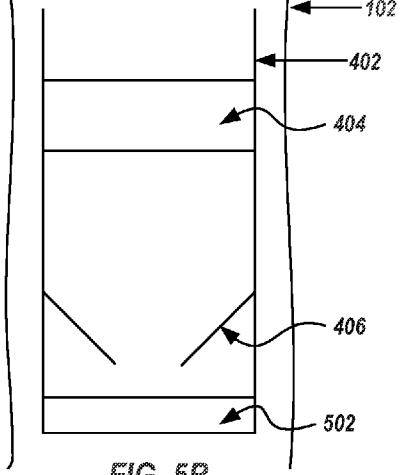
FIG. 5B
FIG. 5C
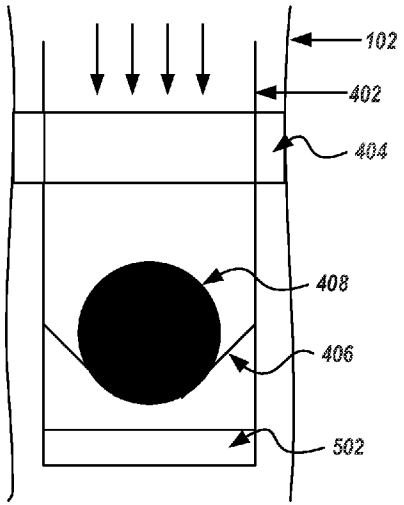
FIG. 5D
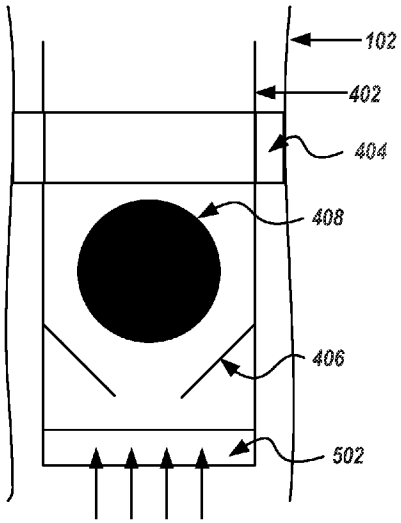
FIG. 5E
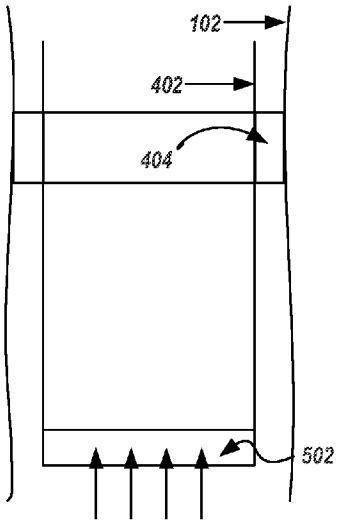
FIG. 5F

PACKER SETTING METHOD USING DISINTEGRATING PLUG

TECHNICAL FIELD

This disclosure relates to wellbore operations.

BACKGROUND

An oil or gas well includes a wellbore extending into a well to some depth below the surface. Typically, the wellbore is lined with a string of tubings, such as casing, to strengthen the walls of the wellbore. To further reinforce the walls of the wellbore, the annular area formed between the casing and the wellbore is typically filled with cement to permanently set the casing in the wellbore. The casing is then perforated to allow production fluid to enter the wellbore from the surrounding formation and be retrieved at the surface of the well. In wellbore operations, packers may be used to control migration of fluids outside a tubing installed in the wellbore.

SUMMARY

This disclosure describes a packer setting method using a disintegrating plug.

Certain aspects of the subject matter described here can be implemented as a method for setting a packer in a wellbore. One or more disintegrating plugs are installed in a tubing. The one or more disintegrating plugs block flow through the tubing in response to pressure. A packer is installed above the one or more disintegrating plugs in the tubing. The tubing including the packer and the one or more disintegrating plugs is run into a wellbore. The packer is positioned at a wellbore location to create an annular area between the packer and the wellbore wall. Downhole pressure is applied in the tubing to set the packer.

This, and other aspects, can include one or more of the following features. Installing the one or more disintegrating plugs in the tubing can include positioning a seat in the tubing to receive the one or more disintegrating plugs, and positioning the one or more disintegrating plugs above the seat. The one or more disintegrating plugs can include a disintegrating ball, and the seat can include a ball seat. The packer can include a packer setting mechanism. In response to applying the downhole pressure in the tubing, the one or more disintegrating plugs are forced against the seat sealing the tubing. The packer setting mechanism can set the packer to create a seal in the annular area between the tubing and an open hole section of a wall of the wellbore or a cased portion of the wellbore. With or without any of the preceding features, production fluids can be produced through the tubing after setting the packer. The one or more disintegrating plugs can be raised from the seat in response to the production. The one or more disintegrating plugs can disintegrate in response to contacting the production fluids. The one or more disintegrating plugs can disintegrate over time. With or without any of the preceding features, the seat can be formed of a disintegrating material. With or without any of the preceding features, an enclosure can be positioned in the tubing, and the one or more disintegrating plugs can be positioned in the enclosure. The enclosure can be a cage. Alternatively or in addition, the enclosure can include multiple baffle plates. With or without any of the preceding features, a pump can be installed below the disintegrating plug in the tubing. The tubing, including the packer, the one or more disintegrating plugs and the pump, can be run into the wellbore. The pump can be an Electrical Submersible Pump (ESP). With or without any of the preceding features, the tubing can include a restriction above a setting port of the packer.

Certain aspects of the subject matter described here can be implemented as a method for setting a packer in a wellbore. A tubing is run into a wellbore. The tubing includes a packer. The tubing includes a restriction above a setting port of the packer and one or more disintegrating plugs positioned below the packer on a seat to receive the one or more disintegrating plugs. Downhole pressure is applied in the tubing to set the packer.

This, and other aspects, can include one or more of the following features. The packer can include a packer setting mechanism. In response to applying the downhole pressure in the tubing, the one or more disintegrating plugs can be forced against the seat sealing the tubing. The packer setting mechanism can set the packer to create a seal in the annular area between the tubing and an open hole section of a wall of the wellbore or a cased portion of the wellbore. Production fluids can be produced through the tubing after setting the packer. The one or more disintegrating plugs are raised from the seat in response to producing. A pump can be installed below the one or more disintegrating plugs in the tubing. The tubing, including the packer, the one or more disintegrating plugs, and the pump can be run into the wellbore. With or without any of the preceding features, the one or more disintegrating plugs can be transferred to a portion of the wellbore below the seat.

Certain aspects of the subject matter described here can be implemented as a method for forming a seal in a wellbore. A tubing is run into a wellbore. The tubing includes a packer and a seat to receive a disintegrating plug. The disintegrating plug is lowered into the tubing after running the tubing into the wellbore. Downhole pressure is applied in the tubing to form a seal between the tubing and an annulus between the tubing and either an open hole section or a cased portion of the wellbore.

Certain aspects of the subject matter described here can be implemented as a means for setting a packer in a wellbore. The means include means for installing a disintegrating plug in a tubing. The disintegrating plug blocks flow through the tubing in response to pressure. The means include a means for installing a packer above the disintegrating plug in the tubing. The means include means for positioning the packer at a wellbore location to create an annular areabetween the packer and the wellbore wall. The means include means for applying downhole pressure in the tubing to set the packer.

The details of one or more implementations of the subject matter described in this disclosure are set forth in the accompanying drawings and the description below. Other features, aspects, and advantages of the subject matter will become apparent from the description, the drawings, and the claims.

BRIEF DESCRIPTION OF THE DRAWINGS

FIGS. 4A-4F are schematic diagrams showing example techniques to set a packer in a wellbore.

FIGS. 5A-5F are schematic diagrams showing example techniques to set a packer in a wellbore.

Like reference numbers and designations in the various drawings indicate like elements.

DETAILED DESCRIPTION

Figure 1:
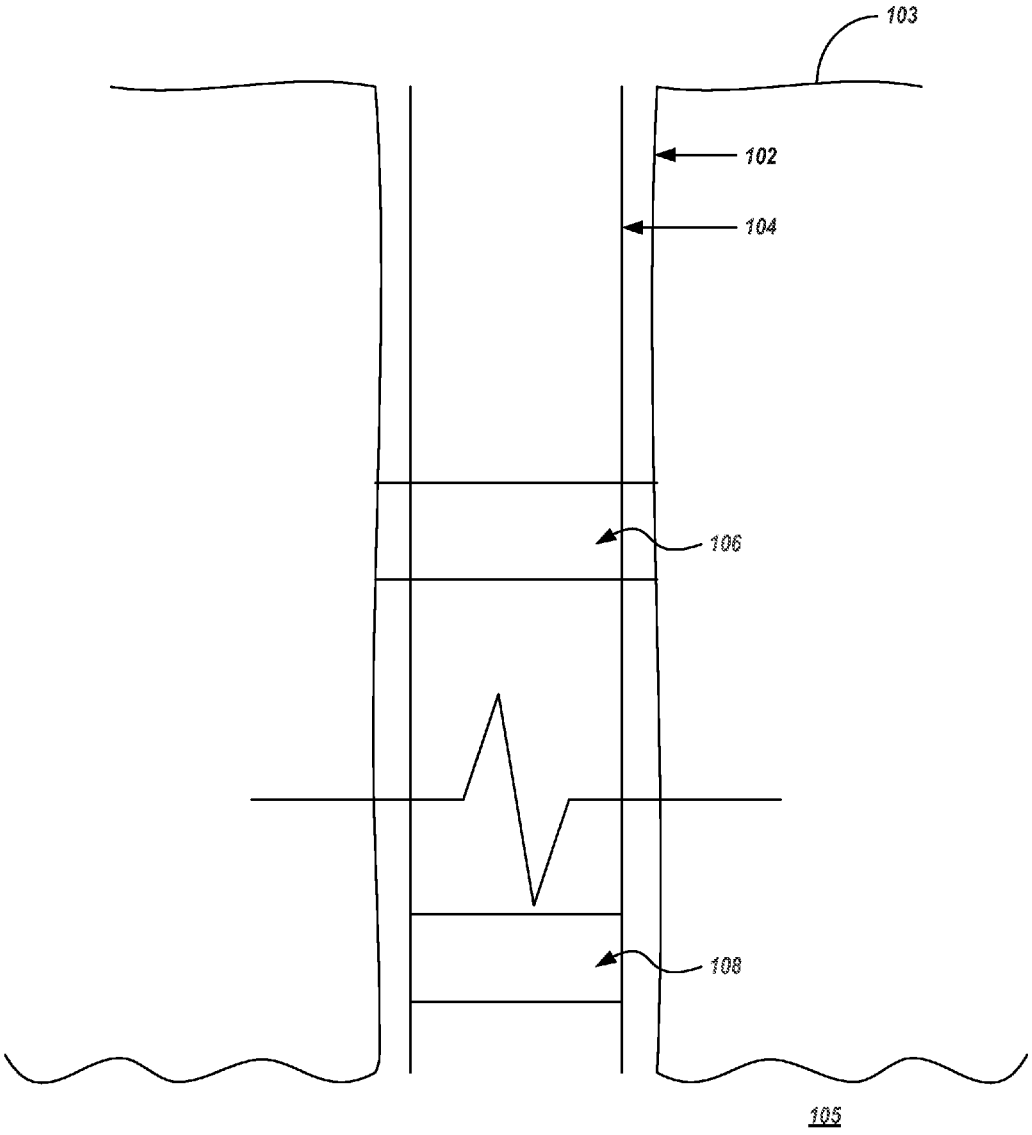
FIG. 1 is a schematic diagram of an example wellbore system including downhole components.

This disclosure describes a packer setting method using a disintegrating plug. Packers may be set by hydraulics, mechanics or hydrostatics. In hydraulically set packers, the hydraulic pressure is introduced through the tubing on which the packer is installed and is communicated to the packer's hydraulically actuated system by a port through the tubing wall, also called a mandrel, on which the packing elements are installed. The port extends through the tubing wall and provides communication from the tubing string inner diameter and the hydraulic cylinder for the packer. There are seals within the cylinder that contain and direct the hydraulic pressure. In this manner, the downhole tubing and annulus are isolated.

Hydraulic set packers sometimes use a temporary block or plug with the tubing below the packer so pressure from the surface can be applied to the hydraulically actuated system to initiate and set the packer. After setting the packer, the temporary block or plug can be removed to allow the production of hydrocarbons from the reservoir. Plugging mechanisms can include dropped balls, standing valves, or other mechanisms. Mechanisms can also be deployed on the tubing to act as temporary barriers, e.g., glass or ceramic disks that can be broken with a dropped bar, flapper type valves which cycles open after setting the packer, or other mechanisms.

For certain packers, e.g., slim-hole, electric submersible pump (ESP) hydraulic-set packer or other packers, a restriction can be included in the tubing above the packer setting port. An ESP packer is an example of a standard hydraulic packer which provides for the through passage of ESP power cables and/or a passage of a vent bore to vent gas. The restriction can be implemented, e.g., as a conduit for ESP power cables. The restriction can cause a narrowing of an inner diameter of the tubing above the packer. Implementing a temporary block or plug, e.g., flapper type valves, in such packers can further narrow the inner diameter of the tubing, e.g., due to the multiple component layers used to operate the block or plug. Further, debris from the breakup of glass or ceramic disks used to set the packer can foul the ESP.

This disclosure describes techniques to set a packer in a wellbore using a disintegrating plug that is installed below the packer. In some implementations, a disintegrating plug is captured below the packer, e.g., a slim-hole ESP packer, below which the ESP is positioned. A plug seat is positioned between the packer and the ESP to retain the disintegrating plug between the plug seat and the restriction in the tubing. During run in of the packer into the wellbore, the plug can float off-seat to allow the tubing to auto-fill. Once the ESP completion is at a specified depth in the wellbore, the tubing is pressured up at the surface to set the packer. When doing so, the plug is forced against the seat allowing pressure to be applied to the packer. With the packer set, the ESP can be started causing fluid (e.g., production fluid) to flow uphole toward the seat. The disintegrating plug flows off seat allowing production through the wellbore. The disintegrating plug will disintegrate over time permitting production fluid flow through the tubing.

FIG. 1 is a schematic diagram of an example wellbore system 100 including downhole components. The wellbore 102 is drilled through a subterranean zone (e.g., a formation, a portion of a formation, or multiple formations) to a reservoir 105 from which production fluids (e.g., hydrocarbons, gas, oil, combinations of them) can be produced. In some implementations, the wellbore 102 can be completed with a casing. In some implementations, the downhole components can include a packer 106 or a pump 108, e.g., an ESP, both, or other components. In some implementations, the packer 106 can include a restriction in the tubing above a setting port (not shown) of the packer 106. Techniques to set such packers are described below.

Figure 2A:
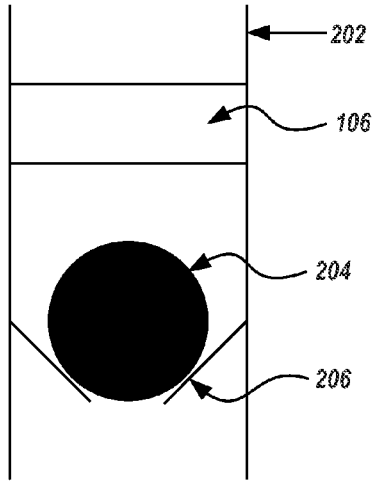
FIGS. 2A-2D are schematic diagrams showing example techniques to set a packer in a wellbore.
Figure 8:
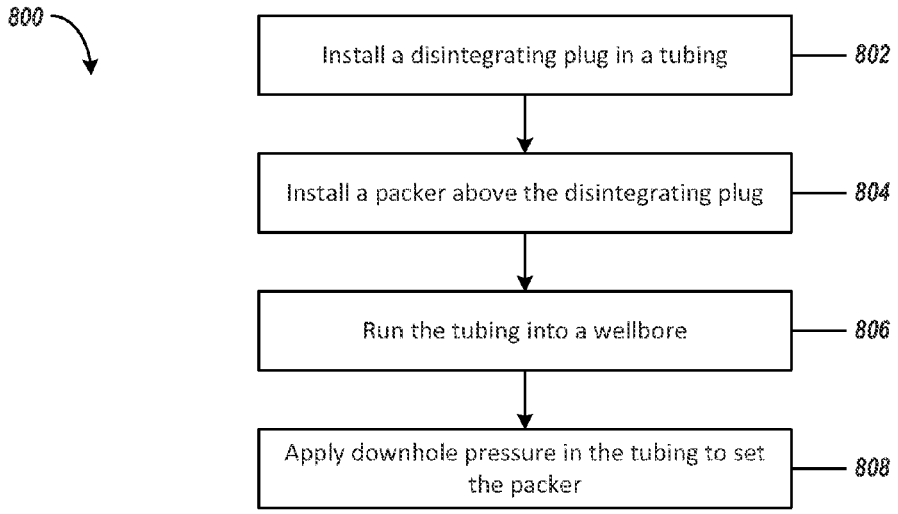
FIG. 8 is a flowchart of an example process to set a packer in a wellbore.
Figure 9:
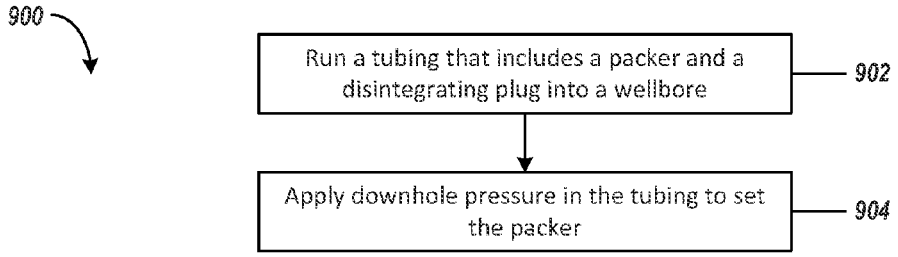
FIG. 9 is a flowchart of an example process to set a packer in a wellbore.
Figure 10:
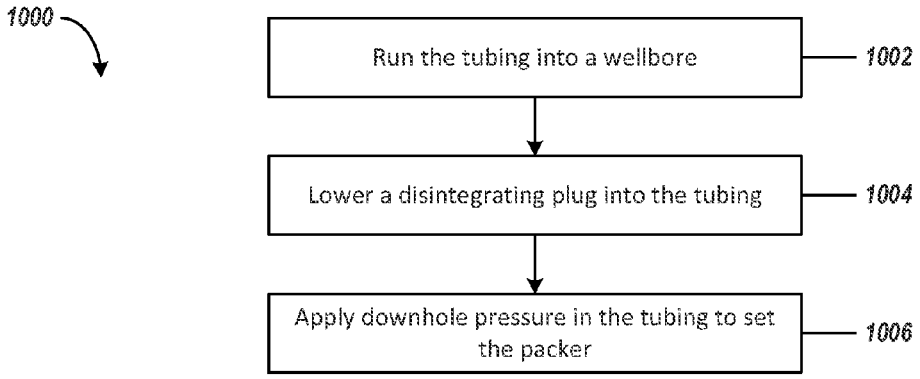
FIG. 10 is a flowchart of an example process to set a packer in a wellbore.

FIGS. 2A-2D, FIGS. 3A-3D, FIGS. 4A-4F and FIGS. 5A-5F are schematic diagrams showing example techniques to set a packer in a wellbore. The techniques are described can be implemented as described with reference to either the flowchart in FIG. 8 or the flowchart in FIG. 9 or both. In some implementations, at 802, a disintegrating plug 204 is installed in a tubing 202 as shown in FIG. 2A. The disintegrating plug 204 is designed to block flow through the tubing 202 in response to pressure as described below. For example, the disintegrating plug 204 is a disintegrating ball with a substantially spherical shape. A seat 206 is positioned in the tubing 202 to receive the disintegrating plug 204. The disintegrating plug 204 is positioned above the seat 206. In response to downhole pressure, the disintegrating plug 204 is forced against the seat 206 forming a pressure seal. In response to uphole pressure, the disintegrating plug 204 is forced off the seat 206. The disintegrating plug 204 is formed of a material having a density greater than a density of fluids (e.g., production fluids or other fluids) that flow through the tubing 202. The disintegrating plug 204 is formed of a material that disintegrates either over time or when contacted by production fluids or both.

Figure 2B:
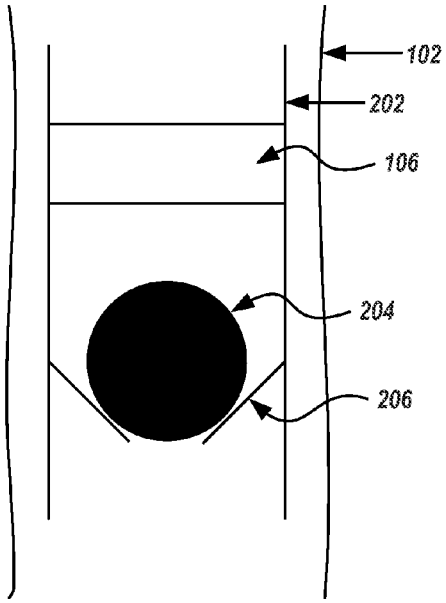
Figure 2C:
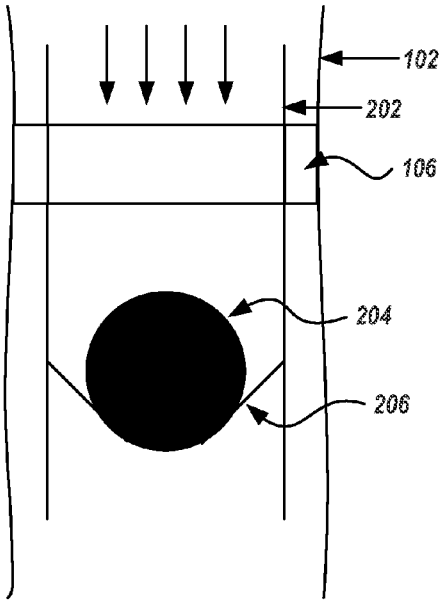
Figure 2D:
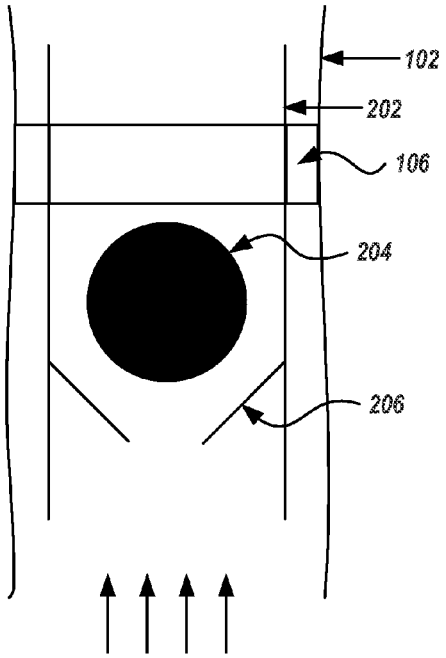

At 804, a packer 106 is installed above the disintegrating plug 204 in the tubing 202. For example, the packer 106 is a slim-hole ESP packer. In this manner, the disintegrating plug 204 is captured between the packer 106 and the seat 206. At 806, the tubing 202 including the packer 106 and the disintegrating plug 204 are run into a wellbore 102 as shown in FIG. 2B. The packer 106 is lowered to a specified depth and positioned at a wellbore location to create an annular area between the packer 106 and a wall of the wellbore 102. At 808, downhole pressure is applied in the tubing 202 to set the packer 106. The arrows in FIG. 2C indicate a direction in which hydraulic pressure is applied. In response to the pressure, the disintegrating plug 204 is forced against the seat 206 forming a pressure seal. The hydraulic pressure causes the packer setting mechanism in the packer 106 to set the packer 106 at the wellbore location. In this manner, the packer 106 creates a seal in the annular area between the tubing 202 and an open hole section of the wall of the wellbore 102. After setting the packer 106, production through the wellbore 102 can commence. In some situations as shown in FIG. 2D, the production fluids in the reservoir 105 can flow uphole due to a pressure difference between the reservoir 105 and the surface. The uphole flowing production fluids can raise the disintegrating plug 204 from the seat 206 allowing the production fluid flow. The packer 106 regulates the production fluid flow through the tubing 202. Over time or in response to contacting the production fluids (or both), the disintegrating plug 204 disintegrates permitting unrestricted flow of the production fluids to the surface.

Figure 3A:
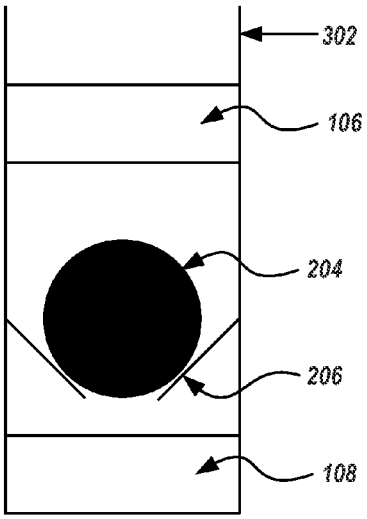
FIGS. 3A-3D are schematic diagrams showing example techniques to set a packer in a wellbore.
Figure 3B:
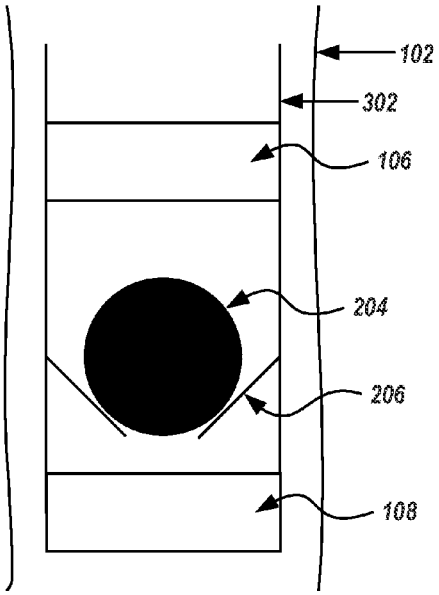
Figure 3C:
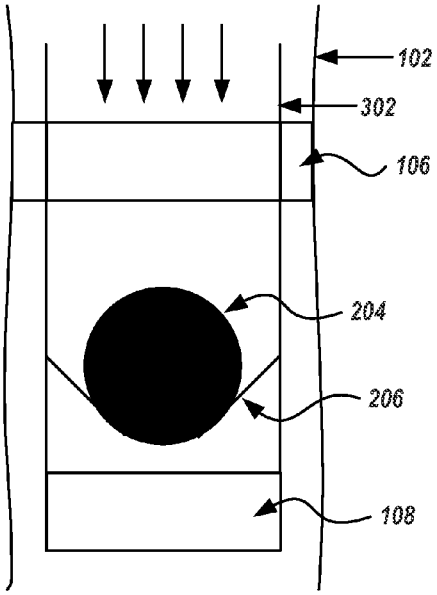
Figure 3D:
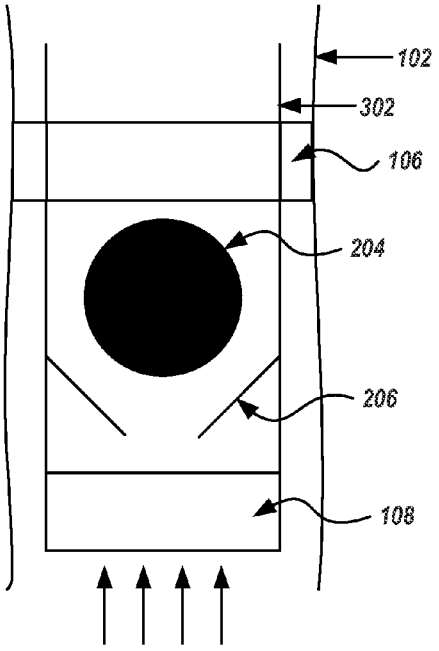

FIGS. 3A-3D are schematic diagrams showing example techniques to set a packer in a wellbore. In some implementations, as shown in FIG. 3A, a packer 106 that includes a restriction in the tubing above a setting port (e.g., an ESP packer) and a disintegrating plug 204 positioned below the packer on a seat 206 to receive the disintegrating plug 204 is assembled. The packer 106, the disintegrating plug 204 and the seat 206 can be similar to those described above with reference to FIGS. 3A-3D. In some implementations, a pump 108 (e.g., an ESP or other uphole pumping pump) can be installed below the disintegrating plug 204 and the seat 206 in the tubing 302. At 902, the tubing 302 can be run into the wellbore 102 as shown in FIG. 3B. At 904, downhole pressure is applied in the tubing 202 to set the packer 106. The arrows in FIG. 3C indicate a direction in which hydraulic pressure is applied. In response to the pressure, the disintegrating plug 204 is forced against the seat 206 forming a pressure seal. The hydraulic pressure causes the packer setting mechanism in the packer 106 to set the packer 106 at the wellbore location. In this manner, the packer 106 creates a seal in the annular area between the tubing 202 and an open hole section of the wall of the wellbore 102.

After setting the packer 106, production through the wellbore 102 can commence. In some implementations, the ESP 108 can be operated to pump production fluids uphole toward the surface. The uphole flowing production fluids can raise the disintegrating plug 204 from the seat 206 allowing the production fluid flow. The packer 106 regulates the production fluid flow through the tubing 202. Over time or in response to contacting the production fluids (or both), the disintegrating plug 204 disintegrates permitting unrestricted flow of the production fluids to the surface. In either the implementations described with reference to FIGS. 2A-2D or in implementations described with reference to FIGS. 3A-3D (or in both implementations), the seat to receive the disintegrating plug can be made from the same or similar disintegrating material such that either over time or in response to contacting the production fluids (or both), the seat disintegrates further permitting unrestricted flow of the production fluids to the surface.

FIGS. 4A-4F are schematic diagrams showing example techniques to set a packer in a wellbore. In the example implementations described with reference to FIGS. 4A-4F, the disintegrating plug is positioned in the tubing after the tubing has been run into the wellbore. FIG. 4A shows a packer 404 and a seat 406 installed in a tubing 402. At 1002, the tubing 402 is run into the wellbore 102 as shown in FIG. 4B. When the tubing 402 is run into the wellbore 102, the tubing 402 does not include a disintegrating plug. At 1004, the disintegrating plug 408 is lowered into the tubing 402 as shown in FIG. 4C. For example, the disintegrating plug 408 is dropped into the tubing 402 at the surface. The disintegrating plug 408 is made of a material that has a specific gravity that is greater than a specific gravity of fluid in the tubing 402 allowing the disintegrating plug 408 to descend into the tubing 402. Because a size of the seat 406 is less than an effective diameter of the disintegrating plug 408, the disintegrating plug 408 cannot descend below the seat 406. Such an arrangement can be implemented without a wellbore restriction above the seat 406.

At 1006, downhole pressure is applied in the tubing 402 to set the packer 404. Similar to the implementations described above, the arrows in FIG. 4C indicate a direction in which hydraulic pressure is applied. In response to the pressure, the disintegrating plug 408 is forced against the seat 406 forming a pressure seal. The hydraulic pressure causes the packer setting mechanism in the packer 404 to set the packer 404 at the wellbore location. In this manner, the packer 404 creates a seal in the annular area between the tubing 402 and an open hole section of the wall of the wellbore 102 or inside a cased wellbore. FIG. 4E shows the production fluids in the reservoir 105 flowing uphole due to a pressure difference between the reservoir 105 and the surface. The uphole flowing production fluids can raise the disintegrating plug 408 from the seat 406 allowing the production fluid flow. The packer 404 regulates the production fluid flow through the tubing 402. Over time or in response to contacting the production fluids (or both), the disintegrating plug 408 disintegrates permitting unrestricted flow of the production fluids to the surface. In some implementations, the seat 406 can also be made from the same or similar disintegrating material as the disintegrating plug 408. FIG. 4F shows both the seat 406 and the plug 408 having disintegrated over time allowing unrestricted flow of production fluids to the surface.

FIGS. 5A-5F are schematic diagrams showing example techniques to set a packer in a wellbore. In some implementations, as shown in FIG. 5A, a packer 404 and a seat 406 are assembled in a tubing 402. The packer 404 and the seat 406 can be similar to those described above with reference to FIGS. 4A-4F. In some implementations, a pump 502 (e.g., an ESP or other uphole pumping pump) can be installed below the seat 406 in the tubing 402. The tubing 402 can be run into the wellbore 102 as shown in FIG. 5B. When the tubing 402 is run into the wellbore 102, the tubing 402 does not include a disintegrating plug. The disintegrating plug 408 is lowered into the tubing 402 as shown in FIG. 5C. Downhole pressure is applied in the tubing 402 to set the packer 404. The arrows in FIG. 5C indicate a direction in which hydraulic pressure is applied. In response to the pressure, the disintegrating plug 408 is forced against the seat 406 forming a pressure seal. The hydraulic pressure causes the packer setting mechanism in the packer 404 to set the packer 404 at the wellbore location. In this manner, the packer 404 creates a seal in the annular area between the tubing 402 and an open hole section of the wall of the wellbore 102 or inside the cased wellbore.

After setting the packer 404, production through the wellbore 102 can commence. As shown in FIG. 5D, the ESP 502 can be operated to pump production fluids uphole toward the surface. The uphole flowing production fluids can raise the disintegrating plug 408 from the seat 406 allowing the production fluid flow. The packer 404 regulates the production fluid flow through the tubing 402. Over time or in response to contacting the production fluids (or both), either the disintegrating plug 408 or both the disintegrating plug 408 and the seat 406 disintegrate permitting unrestricted flow of the production fluids to the surface as shown in FIG. 5F.

Figure 7:
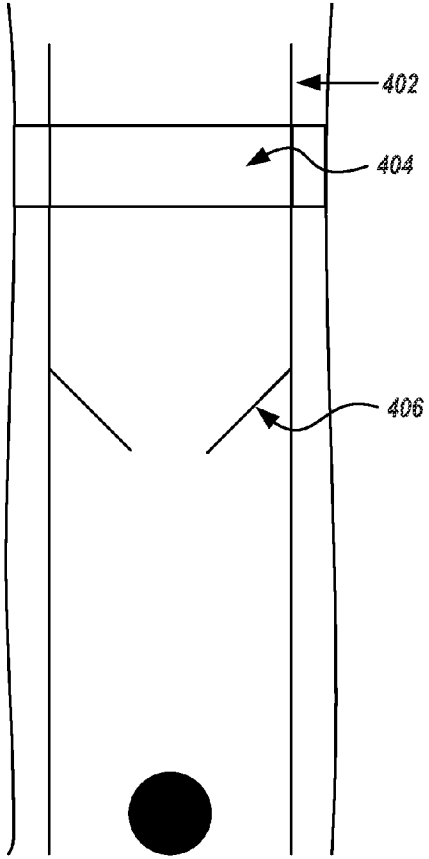
FIG. 7 is a schematic diagram showing a disintegrating plug transferred to a downhole portion of a wellbore.
Figure 6:
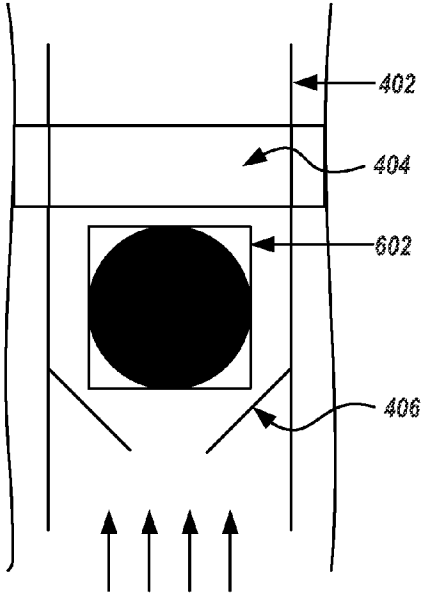
FIG. 6 is a schematic diagram showing a disintegrating plug positioned in an enclosure.

FIG. 6 is a schematic diagram showing a disintegrating plug positioned in an enclosure 602. In some implementations, the disintegrating plug 408 can be positioned in the enclosure 602 (e.g., a cage, a structure including multiple baffle plates, or other structure). The enclosure 602 can be positioned between the packer 404 and the seat 406 before lowering the tubing 402 that includes the enclosure 602, the packer 404 and the seat 406 into the wellbore 102. Alternatively, the enclosure 602 can be lowered into the tubing 402 after running the tubing 402 to the wellbore location. Enclosing the disintegrating plug 408 in the enclosure 602 can decrease a risk of plug debris entering the pump or surface equipment as the size of the plug is reduced. In some implementations, the enclosure 602 can also be made of the same or similar disintegrating material as the plug 408. In some implementations, the disintegrating plug 408 can be transferred to a portion of the wellbore 102 that is below the seat 406, e.g., to a rat hole, as shown in FIG. 7.

In some implementations, the arrangement of a disintegrating plug above a seat in a tubing can be implemented for purposes other than setting a packer, e.g., testing tubing or other downhole activities which may require the application of differential pressure without the movement of a sleeve to open or close communication between the tubing and the annulus. In any of the implementations described above and/or in other implementations, the seat can be solid or flexible. Solid seats may not allow the passage of the plug unless the plug disintegrates to a size smaller than an opening in the seat. Flexible seats can retract to allow passage of the plug. In any of the implementations described above and/or in other implementations, the plug may not be formed of a disintegrating material. Instead, the plug can be formed of a material that has a specific gravity less than a specific gravity of the production fluids that flow uphole through the tubing, thereby allowing the plug to rise above the seat to permit flow through the seat. In implementations in which the plug is formed of disintegrating material, the plug may disintegrate entirely until the plug dissolves away or partially to reduce to a dimension sufficient to permit production fluid flow and/or removal of the plug.

The example implementations described above describe setting one packer. In some implementations, multiple packers can be set by implementing techniques similar to those described here. For example, multiple packers can be installed in a tubing and a disintegrating plug and a seat can be installed below the lowest packer. Downhole pressure in the tubing can force the plug against the seat causing a pressure seal which can be used to set all the packers. In some situations, each packer can be associated with a respective, different setting pressure to enable witnessing the setting of each packer.

A number of implementations have been described. Nevertheless, it will be understood that various modifications may be made without departing from the spirit and scope of the disclosure.

The invention claimed is:

1. A method for setting a packer in a wellbore, the method comprising:

installing a disintegrating plug in a tubing, the disintegrating plug to block flow through the tubing in response to pressure, wherein installing the disintegrating plug in the tubing comprises:

positioning a disintegrating enclosure in the tubing, wherein the enclosure comprises a plurality of baffle plates, and positioning the disintegrating plug in the disintegrating enclosure;

installing a packer above the disintegrating plug in the tubing;

running the tubing including the packer and the disintegrating plug into a wellbore;

positioning the packer at a wellbore location to create an annular area between the packer and the wellbore wall; and applying downhole pressure in the tubing to set the packer.

2. The method of claim 1, wherein installing the disintegrating plug in the tubing comprises:

positioning a seat in the tubing to receive the disintegrating plug; and positioning the disintegrating plug above the seat.

3. The method of claim 2, wherein the disintegrating plug comprises a disintegrating ball, and wherein the seat comprises a ball seat.

4. The method of claim 2, wherein the packer comprises a packer setting mechanism, and wherein, in response to applying the downhole pressure in the tubing, the disintegrating plug is forced against the seat sealing the tubing, and wherein the packer setting mechanism sets the packer to create a seal in the annular area between the tubing and an open hole section of a wall of the wellbore or a cased portion of the wellbore.

5. The method of claim 2, further comprising producing through the tubing after setting the packer, wherein the disintegrating plug is raised from the seat in response to producing.

6. The method of claim 5, wherein the disintegrating plug disintegrates in response to contacting production fluids.

7. The method of claim 5, wherein the disintegrating plug disintegrates over time.

8. The method of claim 2, wherein the seat is formed of a disintegrating material.

9. The method of claim 1, wherein the enclosure is a cage.

10. The method of claim 1, further comprising:

installing a pump below the disintegrating plug in the tubing; and running the tubing including the packer, the disintegrating plug, and the pump into the wellbore.

11. The method of claim 10, wherein the pump is an Electrical Submersible Pump (ESP).

12. The method of claim 1, wherein the tubing includes a restriction above a setting port of the packer.

13. A method for setting a packer in a wellbore, the method comprising:

running a tubing into a wellbore, the tubing comprising:

a packer, the tubing comprising a restriction above a setting port of the packer, a disintegrating enclosure formed of a material that disintegrates over time when contacted by production fluids, wherein the disintegrating enclosure comprises a plurality of baffle plates, and a disintegrating plug positioned in the disintegrating enclosure, the disintegrating plug and the disintegrating enclosure positioned below the packer on a seat to receive the disintegrating plug; and applying downhole pressure in the tubing to set the packer.

14. The method of claim 13, wherein the packer comprises a packer setting mechanism, and wherein, in response to applying the downhole pressure in the tubing, the disintegrating plug is forced against the seat sealing the tubing, and wherein the packer setting mechanism sets the packer to create a seal in the annular area between the tubing and an open hole section of a wall of the wellbore or a cased portion of the wellbore.

15. The method of claim 13, further comprising producing through the tubing after setting the packer, wherein the disintegrating plug is raised from the seat in response to producing.

16. The method of claim 13, further comprising:

installing a pump below the disintegrating plug in the tubing; and running the tubing including the packer, the disintegrating plug, and the pump into the wellbore.

17. The method of claim 13, further comprising transferring the disintegrating plug to a portion of the wellbore below the seat.

18. The method of claim 1, wherein each of the disintegrating enclosure and the disintegrating plug is formed of a material that disintegrates over time when contacted by production fluids.

* * * * *